US007780822B2

(12) United States Patent
Beckmann et al.

(10) Patent No.: US 7,780,822 B2
(45) Date of Patent: Aug. 24, 2010

(54) ELECTROLYTIC CELL WITH SEGMENTED AND MONOLITHIC ELECTRODE DESIGN

(75) Inventors: Roland Beckmann, Lünen (DE); Karl Heinz Dulle, Olfen (DE); Frank Funck, Mülheim (DE); Randolf Kiefer, Bochum (DE); Peter Woltering, Neuenkirchen (DE)

(73) Assignee: UHDENORA S.p.A., Milan (IT)

( * ) Notice: Subject to any disclaimer, the term of this patent is extended or adjusted under 35 U.S.C. 154(b) by 469 days.

(21) Appl. No.: 11/795,122

(22) PCT Filed: Jan. 25, 2006

(86) PCT No.: PCT/EP2006/000644

§ 371 (c)(1),
(2), (4) Date: Jul. 11, 2007

(87) PCT Pub. No.: WO2006/079523

PCT Pub. Date: Aug. 3, 2006

(65) Prior Publication Data

US 2008/0093214 A1 Apr. 24, 2008

(30) Foreign Application Priority Data

Jan. 25, 2005 (DE) ..... 10 2005 003 526

(51) Int. Cl.
*C25B 9/04* (2006.01)
*C25B 9/08* (2006.01)
*C25B 11/02* (2006.01)

(52) U.S. Cl. ..... 204/252; 204/194

(58) Field of Classification Search ..... 204/252
See application file for complete search history.

(56) References Cited

U.S. PATENT DOCUMENTS 4,059,216 A * 11/1977 Meyer ..... 228/179.1

* cited by examiner

*Primary Examiner*—Harry D Wilkins, III
*Assistant Examiner*—Zulmariam Mendez
(74) *Attorney, Agent, or Firm*—Charles A. Muserlian

(57) ABSTRACT

An electrolytic cell consisting of two semi-shells and encompassing mainly the inlet and outlet devices, components for the flow control, a membrane as well as anode and cathode.

7 Claims, 2 Drawing Sheets

ELECTROLYTIC CELL WITH SEGMENTED AND MONOLITHIC ELECTRODE DESIGN

This application is a 371 of PCT/EP2006/000644 filed Jan. 25, 2006.

The invention relates to an electrolytic cell essentially consisting of two semi-shells encompassing inlet and outlet devices, components for flow control, an anode and a cathode separated by a membrane. The electrode may have any surface structure and it is connected to the respective semi-shell on the side opposite to the membrane through a multiplicity of conductive strips. According to the invention, at least one of the two electrodes is provided with a segmented structure, each of the electrode segments and its adjacent supporting strips being fabricated as a monolithic jointless assembly from a single semi-finished workpiece.

It is a state-of-the-art practice to weld the electrodes to the inner wall of the respective semi-shell through strips that are arranged perpendicularly to the electrode and the semi-shell rear wall, i.e. aligned in the direction of the pressing force. Electrically insulating spacers are inserted in the area between the membrane and the electrodes such that the membrane is clamped and consequently fixed between a multiplicity of spacers with the pressing force acting from the external side. The spacers are arranged in opposed pairs and the strips are positioned in correspondence of the spacers on the opposite side of the electrode.

Electrolysers of this type are for instance described in DE 196 41 125 and EP 0 189 535. The cell components are optimised in order to minimise the amount of required material simultaneously ensuring the necessary stiffness and strength of the finished cell. When fabricating a device in accordance with DE 196 41 125 it is necessary to prefabricate the individual members, part of which have a relatively reduced thickness, to position the same in a straightening bench and to weld them together to assemble the cell. In case of large orders this is a very time-consuming and expensive process, considering that one electrolyser room is usually comprised of many thousand individual cells.

Stringent requirements must be met for the dimensional accuracy of the cell components because even minor deviations which may be caused for instance by thermal expansion of the material, inaccurate positioning of components or dimensional variation of individual components, may lead to problems of installation or of cell operation.

It is therefore one of the aims of the invention to overcome the inadequacy of the present technology and to provide an electrolyser comprising cell components of improved dimensional accuracy and easier to install.

This and other aims are achieved by means of an electrolytic cell essentially consisting of two semi-shells encompassing inlet and outlet devices, components for flow control, an anode and a cathode separated by a membrane. The electrodes may have any surface structure, profile or perforation. On the side opposite to the membrane, the electrodes are electrically connected with the respective semi-shell through strips and are characterised by a segmented design, each electrode segment being formed from a single semi-finished piece as a jointless monolith comprising at least one and preferably two adjacent supporting strips.

The segmented structure of the electrode of the invention is particularly advantageous in that the tolerance margin can be consequently reduced, in particular since the tolerance in the body height merely depends on one component or processing step, which is particularly important considering the big electrode size in the standard practice (2-3 $m^2$). Conversely, in the design of the state of the art the overall construction tolerance is determined by the features of two distinct components, namely the length of the strip and the thickness of the electrode sheet, whose junction is moreover exposed to the thermal impact of the welding process.

Positioning the electrode parallel to the membrane plane is facilitated as the strips are already attached to the electrode. Allowing for a displacement during the alignment can also be obtained in a straightforward manner by providing a correspondingly large tolerance in the contact area of the strip feet and in the level parallel to the membrane. No thermal distortion will take place when the strips are fixed to the electrode as these are no longer welded but cold-formed on bending or punching machines. A further advantage is obviously in the reduced quantity of individual components compared to those required for the standard practice.

In an improved embodiment of the invention the strips are provided with one or several feet aligned parallel to the electrode, formed from the same monolithic semi-finished piece as a jointless integral element and then welded to the respective semi-shell of the electrolytic cell. The strip feet facilitate the welding also enhancing the stiffness of the monolithic electrode segments and of the cell as a compact assembly.

In a more preferred embodiment the electrode segment feet are advantageously shaped as teeth matching the tooth profile of the adjacent electrode segment.

In a preferred embodiment of the invention the strip feet are bent along the whole length of the strip so that they all run parallel to the electrode and point in the same direction. This variant permits any width of the feet attached to the monolithic electrode segments.

Moreover, the invention also provides shaped pieces to be positioned between the strips of adjacent electrode segments and on the transition edges between the electrodes and the strips, in order to fix the membrane and distribute forces. The shaped pieces and the transition areas of the electrode segments are formed in such a way that they can either be inserted or engaged. The spacer is ideally shaped so that it comprises one section which is located above the membrane and is supported by the electrode and a further section which is inserted as a spring or a plug into the groove formed by the space between adjacent strips.

An important advantage of the improved positioning of the spacers with respect to the standard practice of the prior art was observed in that said spacers were surprisingly brought to overlap more precisely the respective counter-pieces by means of the electrode segments: each electrically insulated spacer renders the membrane inactive in the contact area so that any pair of spacers not precisely overlapping will enlarge the inactive membrane surface area.

A further improved embodiment of the invention provides for strips with grooves in which at least one plate for flow control or for reinforcement of the assembly can be accommodated.

The latter option and the relevant advantage for flow control are not available in the cells of the prior art on the grounds of manufacturing techniques because the degree of freedom required in that case for the alignment of the strips would have been lost as a result of such an inserted plate. However, since in the electrolytic cell of the present invention the strips are fixed and the spacers placed at the transition edges of the electrodes are aligned thereto, this option can be easily practiced.

A particularly preferred embodiment provides for a groove for accommodating a plate angled up to 15° to the electrode. The halogen gas formed during cell operation rises in form of gas bubbles so that in the upper part of the electrolytic cell a larger volume fraction is occupied by foam and gas bubbles.

An inclined plate establishing a larger open cross-section in the upper part of the electrode allows optimising the foam discharge from the cell and the return flow of residual liquor to the lower part of the electrode.

The invention is hereinafter described by means of the attached drawings which are provided by way of example and shall not be intended as a limitation of the scope thereof.

Figure 1:
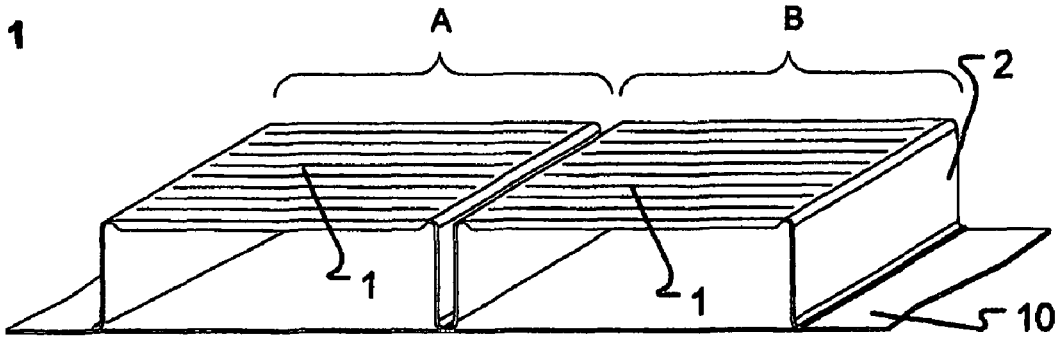
FIG. 1 is a perspective view of two electrode segments in accordance with the present invention.

FIG. 1 illustrates the perspective view of two segments, indicated as A and B, of electrode 1. The electrode 1 is secured to strips 2 via the transitional area 3 on both sides.

The strips 2 are provided with feet 4 parallel to the major surface of electrode 1 and bent towards the external side perpendicularly to strip 2. The strip feet 4 are secured to the rear side 10 of the cell wall. The feet 4 shown in FIG. 1 are continuous.

Figure 2:
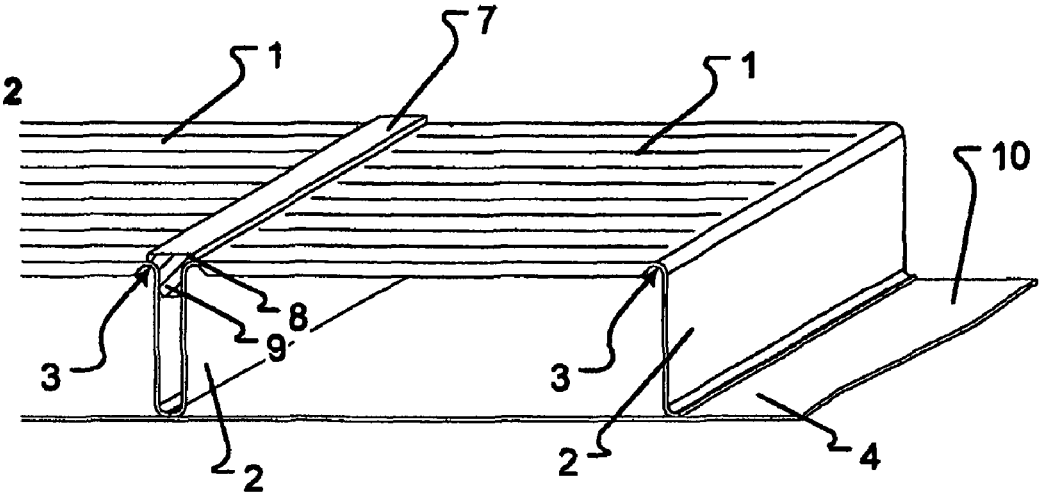
FIG. 2 is a perspective view of two electrode segments in accordance with the present invention provided with spacers.

FIG. 2 illustrates a spacer 7 placed in the transitional area 3 between electrode 1 and strip 2. There is also shown a shaped piece whose upper part 8 is located in the transitional area 3 and whose lower part 9 is inserted into the gap formed by adjacent strips 2. The feet 4 shown in FIG. 2 are also continuous feet.

Figure 3:
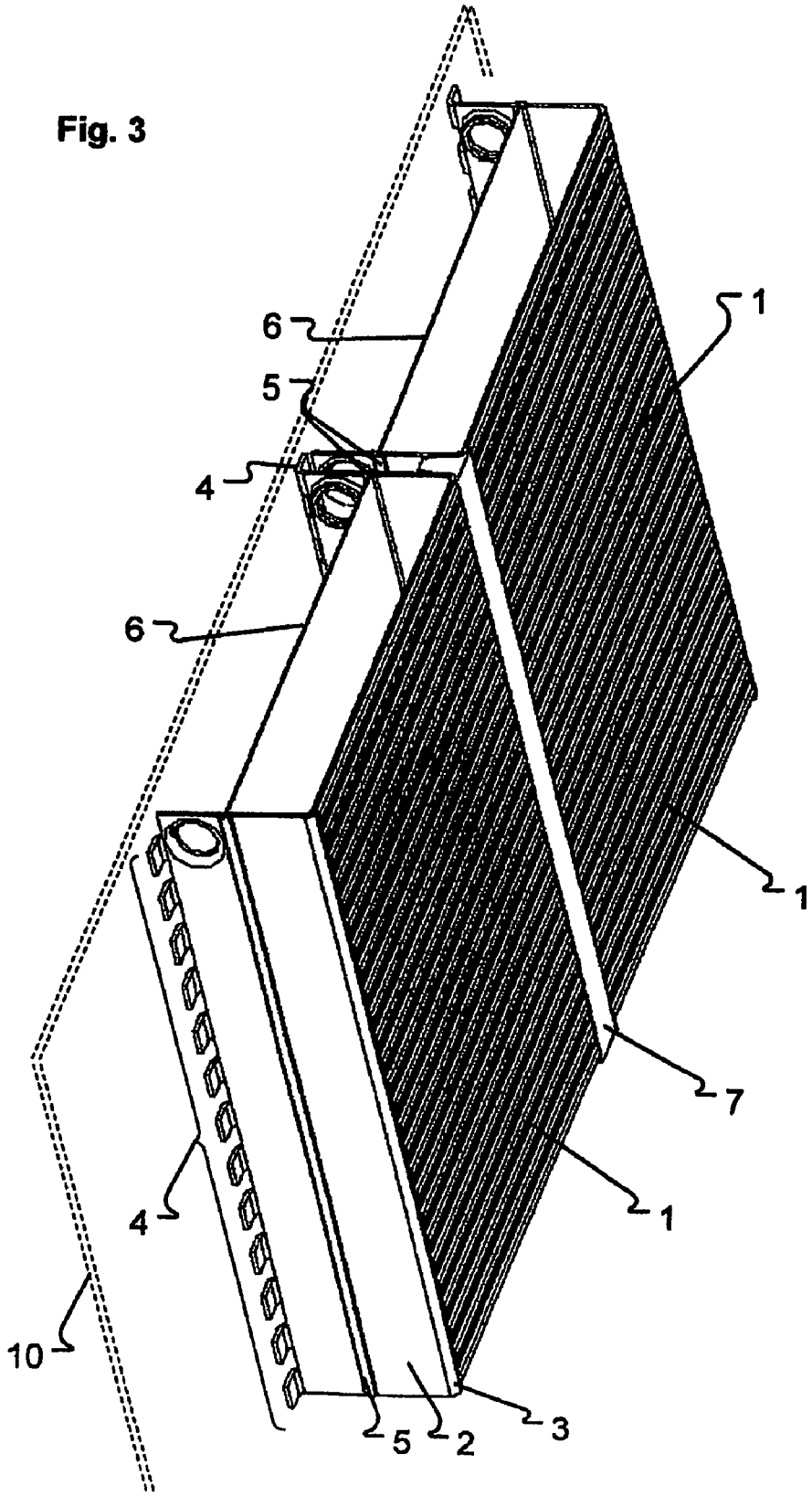
FIG. 3 shows a preferred embodiment of two electrode segments in accordance with the present invention comprising a plate for reinforcement and flow control.

FIG. 3 depicts an embodiment wherein the strip feet 4 are shaped as teeth. The rows of teeth are inserted in the construction phase below the adjacent strip, so that a supporting surface as small as possible is formed. The dimensions of the individual teeth are selected so that a small adjustment space in the inserted state and before welding is provided for a possible necessary alignment.

FIG. 3 also shows two electrode segments which in this example have a lamellar structure. A groove 5 is provided in the strips 2, in which the plate 6 is inserted. On the one hand, this plate improves the stability of the electrode segments and on the other hand it delimits two flow channels establishing respective counter-current flows. During cell operation there is an upward stream in the space between electrode 1 and plate 6 and a downward stream. In the space between cell rear wall 10 (shown as dashed line) and plate 6. The flow change takes place in the space at the upper and lower end of the electrolyser. In a test cell, the flat electrode of the prior art design with an overall anode surface area of 2.7 $m^2$ was replaced by an electrode according to the invention comprising 18 segments, each with an electrode surface area of 0.15 $m^2$. Such cell was operated at a current density of 3 $kA/m^2$ and 6 $kA/m^2$.

The use of the electrolysis cell of the invention permitted a reduction of the cell voltage by 8 mV at a current density of 3 $kA/m^2$ and by approx. 16 mV at a current density of 6 mV.

The above description shall not be understood as limiting the invention, which may be practised according to different embodiments without departing from the scopes thereof, and whose extent is solely defined by the appended claims.

In the description and claims of the present application, the word "comprise" and its variations such as "comprising" and "comprised" are not intended to exclude the presence of other elements or additional components.

The invention claimed is:

1. An electrolytic cell delimited by two semi-shells, each fixed to an electrode by means of a multiplicity of conductive strips, the electrodes being an anode and a cathode having a major surface separated by a membrane, wherein at least one of the electrodes is made of a multiplicity of electrode segments, each of said electrode segments being attached to at least one of said conductive strips prior to the fixing to the respective semi-shell, said electrode segments and said conductive strips attached thereto being obtained as jointless integral elements from single semi-finished workpieces, a multiplicity of shaped pieces are placed between said strips of adjacent electrode segments and at the transition edges between the said electrodes and said strips, comprising a first section located above the membrane and a second section located between said strips in the construction state.

2. The cell of claim 1 wherein each of said electrode segments is attached to two of said conductive strips.

3. The cell of claim 1 wherein the conductive strips are provided with protruding feet parallel to the major surface of said at least one electrode, said feet being part of said jointless integral elements obtained from said single semi-finished workpiece, said feet being welded to the respective semi-shell of the electrolytic cell.

4. The cell of claim 3 wherein said feet are shaped as teeth matching the opposite tooth profile of an adjacent electrode segment.

5. The cell of claim 3 wherein said feet are bent along the overall length of the strip so that they are in a position parallel to the major surface of said at least one electrode and pointing towards the same direction.

6. The cell of claim 1 wherein said strips are provided with a groove in which it is inserted at least one reinforcement plate.

7. The cell of claim 6 wherein said groove accommodating said plate is angled up to 15° to the electrode.

* * * * *